US006364013B1

(12) United States Patent
Watson et al.

(10) Patent No.: US 6,364,013 B1
(45) Date of Patent: Apr. 2, 2002

(54) SHROUD FOR USE WITH ELECTRIC SUBMERGIBLE PUMPING SYSTEM

(75) Inventors: Arthur I. Watson; Didier Drablier; Jerry Stevens, all of Singapore (SG)

(73) Assignee: Camco International, Inc., Houston, TX (US)

( * ) Notice: Subject to any disclaimer, the term of this patent is extended or adjusted under 35 U.S.C. 154(b) by 0 days.

(21) Appl. No.: 09/470,199

(22) Filed: Dec. 21, 1999

(51) Int. Cl.[7] ..... E21B 43/00

(52) U.S. Cl. ..... 166/105; 166/68; 166/369; 417/366; 417/423.14

(58) Field of Search ..... 166/105, 68, 105.5, 166/369; 405/195.1, 211, 224.2; 417/423.14, 366

(56) References Cited

U.S. PATENT DOCUMENTS

| | | | | |
|---|---|---|---|---|
| 4,126,406 A | | 11/1978 | Traylor et al. | |
| 4,537,257 A | * | 8/1985 | Todd | 166/369 |
| 4,749,034 A | * | 6/1988 | Vandevier et al. | 166/369 |
| 4,799,544 A | | 1/1989 | Curlett | |
| 4,832,127 A | * | 5/1989 | Thomas et al. | 166/369 |
| 5,159,977 A | * | 11/1992 | Zabaras | 166/369 |
| 5,979,559 A | * | 11/1999 | Kennedy | 166/369 |
| 5,988,284 A | * | 11/1999 | Dea | 166/369 |
| 6,033,567 A | * | 3/2000 | Lee et al. | 166/265 |

FOREIGN PATENT DOCUMENTS

| | | |
|---|---|---|
| GB | 2 333 309 | 7/1999 |

* cited by examiner

*Primary Examiner*—David Bagnell
*Assistant Examiner*—Frederick L. Lagman
(74) *Attorney, Agent, or Firm*—Fletcher, Yoder & Van Someren

(57) ABSTRACT

A shroud for use with a submergible pumping system. The shroud is disposed over a submergible motor and includes fluid channels for conducting heat away from the submergible motor. The shroud is formed from a sheet material, such as sheet metal, to permit its use in wellbores having a narrow annular space between the submergible pumping system and the interior surface of the wellbore casing. The sheet material includes longitudinal corrugations to facilitate fluid flow while strengthening the construction of the shroud.

34 Claims, 7 Drawing Sheets

SHROUD FOR USE WITH ELECTRIC SUBMERGIBLE PUMPING SYSTEM

FIELD OF THE INVENTION

The present invention relates generally to a system and method for pumping a production fluid from a subterranean well, and particularly to an electric submergible pumping system having a shroud formed from a sheet material.

BACKGROUND OF THE INVENTION

Pumping systems, such as electric submergible pumping systems are utilized in pumping oil and/or other production fluids from producing wells. A typical submergible pumping system includes components, such as a motor, motor protector, submergible pump and pump intake. In certain applications, a shroud is disposed about certain of the submergible components. For example, a shroud may be employed around the submergible motor to extend upwardly to the pump intake, where it is fastened to the submergible pumping system. Thus, the production fluid is drawn through the shroud, past the motor and into the pump intake. The produced fluid acts as a coolant when drawn past the submerged electric motor.

Conventional shrouds are formed from tubing having an inside diameter larger than the outside diameter of the submergible pumping system components. However, when the annular space between the well casing and the motor is relatively small, much of that space is taken by the wall thickness of the shroud tubing. In fact, in some situations the diameter of the tubing must be reduced to a point that the annular flow space becomes too small to provide sufficient fluid to the pump. This can starve the pump and ultimately damage the pump components. The narrow flow passage is also susceptible to clogging due to deposits or debris in the production fluid.

It would be advantageous to be able to utilize a downhole shroud in a narrow bore wellbore without undue utilization of the cross-sectional wellbore space potentially available as a fluid flow passage.

SUMMARY OF THE INVENTION

The present invention features a device for directing a production fluid along a motor used in a submergible pumping system deployable in a wellbore. The device includes a motor shroud sized to fit within a wellbore. The motor shroud includes a wall that defines an inner flow path of sufficient size to receive the motor therein. The wall of the motor shroud is corrugated to form a plurality of downflow and upflow passages, and a channel for the electrical power cable.

According to another aspect of the present invention, a submergible pumping system is provided for use in pumping a production fluid from a subterranean well. The system includes a submergible pump having a pump intake. Additionally, the system includes a submergible motor operably coupled to the submergible pump. A motor shroud is disposed over at least the submergible motor and the pump intake. The motor shroud is formed by a wall of sheet material. Typically, the sheet material is a sheet metal formed as a corrugated sheet.

According to another aspect of the invention, a method is provided for cooling a downhole component of a submergible pumping system disposed in a narrow wellbore. The method includes placing a corrugated sheet material around the downhole component to form an interior flow path between the sheet material and the downhole component. Additionally, an exterior flow path is formed between the sheet material and the narrow wellbore. The method further includes drawing a wellbore fluid through the exterior flow path in a first direction. Also, the method includes drawing the wellbore fluid through the interior flow path in a second direction.

According to another aspect of the present invention, a method is provided for assembling and deploying a submergible pumping system in a wellbore. The submergible pumping system has a plurality of submergible components and a shroud disposed about at least one of the submergible components. The shroud includes a deformable sidewall and an upper attachment end by which the shroud is coupled to at least one of the submergible components. The method includes assembling the shroud and those submergible components that are at least partially contained within the shroud. The method further includes mounting a first clamp about the shroud and a second clamp about at least one of the submergible components above the deformable sidewall. The method further includes supporting the clamps proximate an upper opening of the wellbore. Additionally, the method includes assembling the remainder of the submergible pumping system above the clamps.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
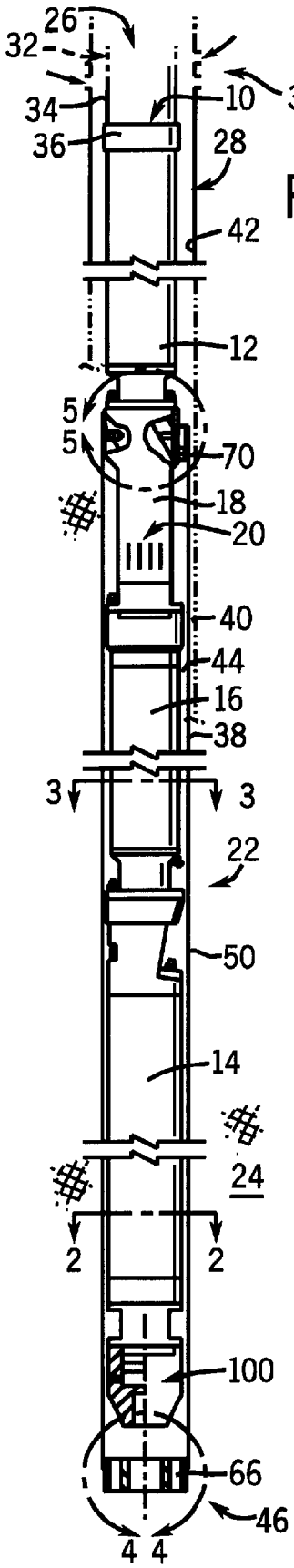
FIG. 1 is a front elevational view of a wellbore in which an exemplary submergible pumping system, according to a preferred embodiment of the present invention, is deployed.

Referring generally to FIG. 1, an exemplary pumping system 10, such as an electric submergible pumping system, is illustrated. Pumping system 10 may comprise a variety of components depending on the particular application or environment in which it is used. Typically, system 10 includes at least a submergible pump 12, a submergible motor 14, a motor protector 16 and a pump intake housing 18 having an intake opening 20 through which a production fluid, such as petroleum, is drawn into intake housing 18 by pump 12.

In the illustrated example, pumping system 10 is designed for deployment in a well 22 within a geological formation 24 containing desirable production fluids, e.g. water or petroleum. In a typical application, a wellbore 26 is drilled and lined with a wellbore casing 28. Wellbore casing 28 includes a plurality of openings or perforations 30 through which production fluids flow from geological formation 24 into wellbore 26.

Pumping system 10 is deployed in wellbore 26 by a deployment system 32 that may have a variety of forms and configurations. For example, deployment system 32 may comprise tubing, e.g. production tubing 34, connected to submergible pump 12 by a connector/discharge head 36.

It should be noted that the illustrated submergible pumping system 10 is merely an exemplary embodiment. Other components can be added to the system, other configurations of components can be utilized, and other deployment systems may be implemented. Additionally, the production fluids may be pumped to the surface through tubing 34 or through the annulus formed between deployment system 32 and wellbore casing 28.

Pumping system 10 further includes a shroud 38 disposed about one or more of the submergible pumping system components. For example, shroud 38 preferably is disposed about submergible motor 14, motor protector 16 and fluid intake 20.

Shroud 38 is disposed within wellbore 26 such that a pair of fluid flow paths are formed. For example, an external fluid flow path 40 is disposed between shroud 38 and an interior surface 42 of wellbore casing 28. Furthermore, an interior fluid flow path 44 is disposed between shroud 38 and the enclosed submergible components, e.g. motor 14 and motor protector 16. Thus, when pump 12 is powered by motor 14, a low pressure area (suction) is created at intake 20. This suction draws wellbore fluid downwardly from perforations 30 through exterior fluid flow path 40. The fluid is drawn around a bottom end 46 of shroud 38 and upwardly through interior fluid flow path 44 to intake 20. The fluid is then discharged upwardly through production tubing 34 via submergible pump 12. The flow of fluid past, for example, submergible motor 14 removes heat created by motor 14 during operation.

Figure 2:
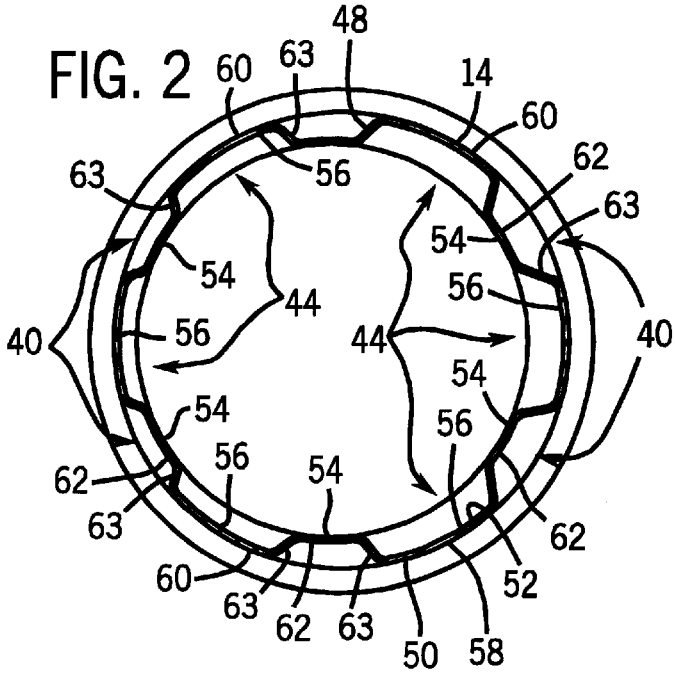
FIG. 2 is a cross-sectional view taken generally along line 2—2 of FIG. 1.
Figure 3:
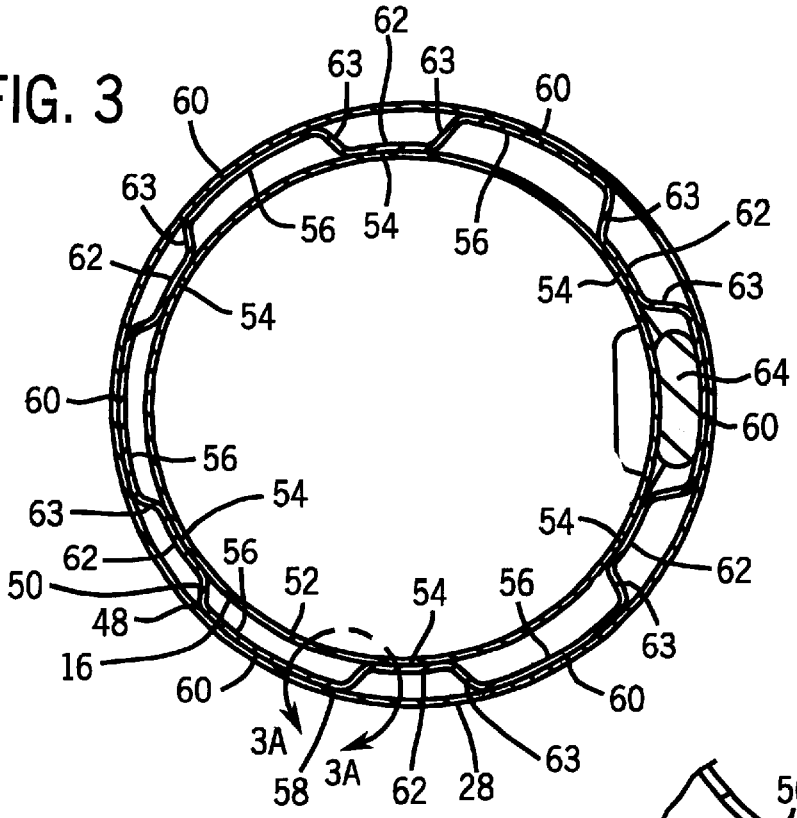
FIG. 3 is a cross-sectional view taken generally along 3—3 of FIG. 1.
Figure 3A:
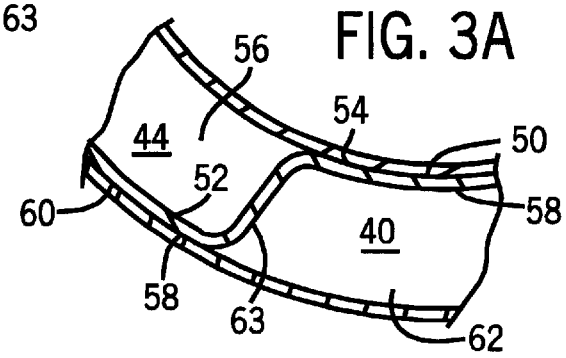
FIG. 3A is an enlarged view of region 3A—3A of FIG. 3.

Shroud 38 is formed from a sheet material 48 to occupy a minimal amount of the cross-sectional annular space between the submergible system components and interior surface 42 of casing 28. Preferably, shroud 38 is formed from sheet metal having a thickness less than approximately ⅛ of an inch. As illustrated best in FIGS. 2 and 3, shroud 38 preferably is corrugated. In other words, sheet material 48 forms a wall 50 about submergible motor 14, motor protector 16 and intake 20 that has longitudinal corrugations running from bottom end 46 to intake 20. The corrugations of wall 50 are formed as a series of alternating ridges and grooves. For example, wall 50 includes an interior surface 52 that has a series of alternating ridges 54 and grooves 56. Grooves 56 form interior fluid flow path 44 that permit fluid to flow upwardly past submergible motor 14 and motor protector 16 to intake 20. Preferably, ridges 54 are disposed against the submergible pumping system components, e.g. motor 14, to further help dissipate heat as production fluid flows past the exterior of shroud 38.

Similarly, wall 50 includes an exterior surface 58 that has a series of alternating ridges 60 and grooves 62. Grooves 62 are formed on an opposite side of wall 50 from interior ridges 54, and ridges 60 are formed on an opposite side of wall 50 from interior grooves 56. Effectively, interior grooves 56 are separated from exterior grooves 62 by a plurality of sidewalls 63. The exterior grooves 62 form exterior fluid flow path 40 along which fluid flows from perforations 30 downwardly to the bottom end 46 of shroud 38.

In the illustrated embodiment, the grooves and ridges are of varying size. For example, interior grooves 56 become progressively larger in cross-sectional area moving from one side of shroud 38 to the other. This design permits the enclosure of a power cable 64 in one of the larger or largest interior grooves 56, as illustrated best in FIG. 3. Power cable 64 may be a conventional power cable utilized in providing power to submergible motor 14.

Figure 4:
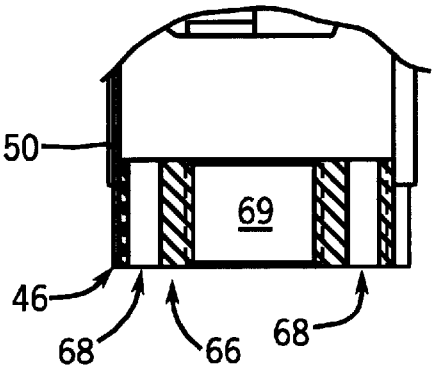
FIG. 4 is an expanded view of the portion encircled by line 4—4 in FIG. 1.

As illustrated in FIG. 4, an end ring 66 is attached to the interior of wall 50 proximate bottom end 46. End ring 66 preferably is a metallic ring having an outer profile that matingly engages and supports the interior surface 52 of shroud 38, to which it is attached by, for example, welding. End ring 66 has one or more axial openings 68 to communicate the external flow path 40 with the interior flow path 44. End ring 66 also includes a central axial opening 69.

Figure 5:
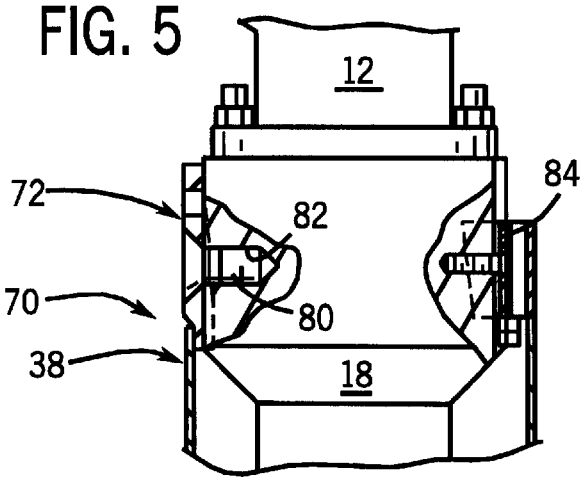
FIG. 5 is an expanded view of the portion encircled by line 5—5 in FIG. 1.

As illustrated in FIG. 5, shroud 38 preferably is attached to at least one of the submergible pumping system components proximate an upper end 70 of shroud 38. For example, shroud 38 may be affixed to intake housing 18 above intake openings 20, as illustrated in FIGS. 1 and 5.

Figure 6:
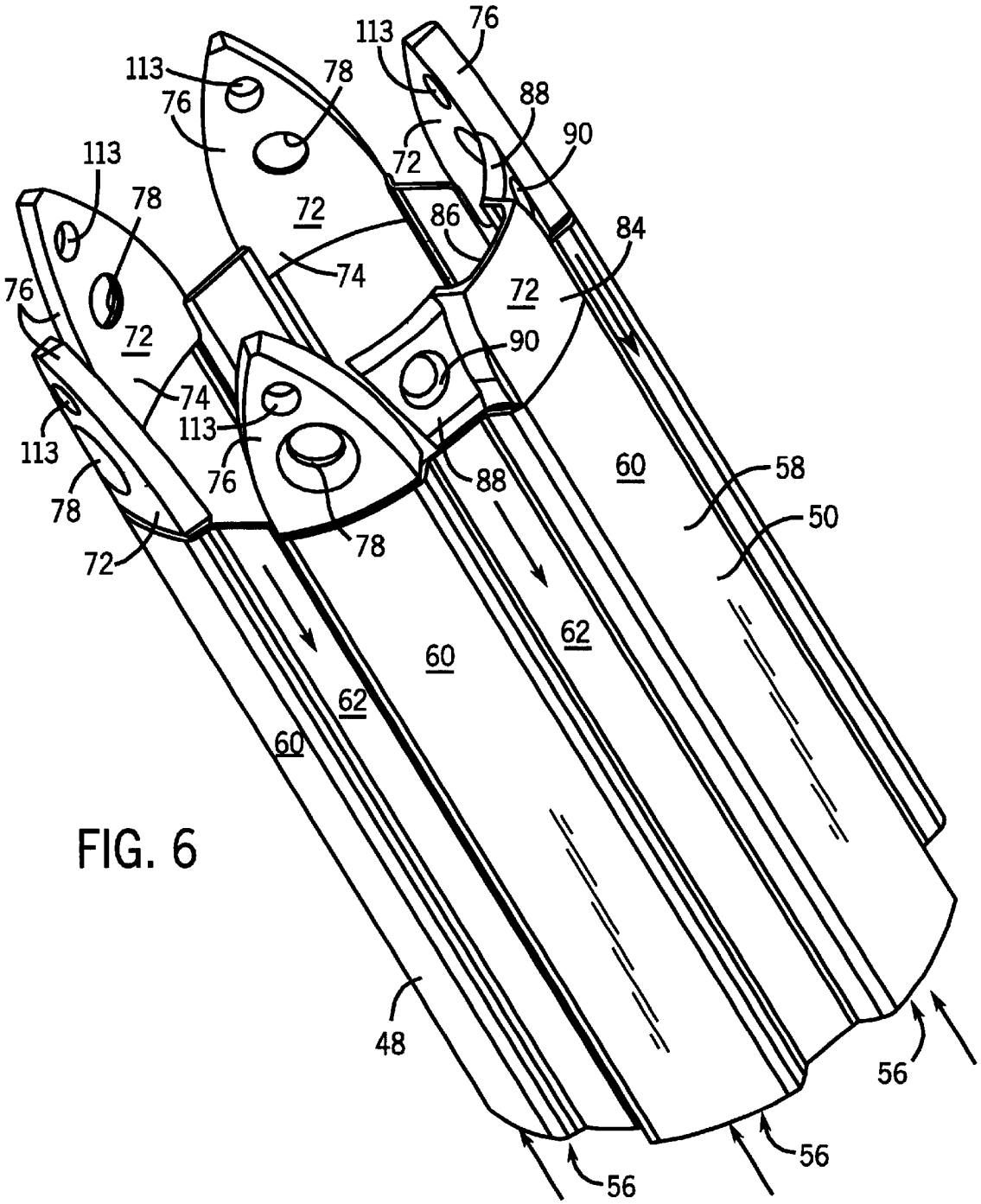
FIG. 6 is a perspective view of an upper attachment portion of the shroud illustrated in FIG. 1.

In the preferred embodiment, a plurality of lugs 72 are utilized to secure sheet material wall 50 to intake housing 18. As illustrated in FIG. 6, each lug 72 includes a base end 74 that matingly engages a corresponding interior groove 56 to block fluid flow therethrough. This ensures that the fluid properly travels downwardly through the exterior grooves of shroud 38 and then upwardly to intake opening 20 through the interior grooves of shroud 38. The lower end 74 of each lug 72 may be attached to wall 50 by, for instance, welding. Several lugs 72 also include an upper tapered portion 76 having an aperture 78 therethrough. Aperture 78 is designed to receive a fastener 80 therethrough, as illustrated best in FIG. 5. An exemplary fastener is a bolt designed for threaded engagement with corresponding threaded apertures 82 disposed in intake housing 18, or in a rotatable member attached to intake housing 18.

Figure 6A:
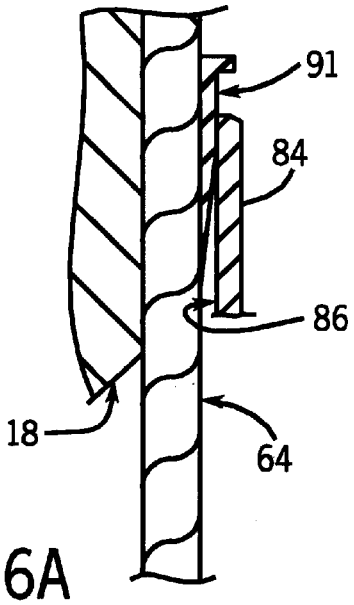
FIG. 6A is a longitudinal cross-sectional view of a power cable extending through the upper attachment portion illustrated in FIG. 6.

If power cable 64 is directed through one of the interior grooves 56, one of the lugs 72 must be formed to accommodate the power cable. Such a lug is illustrated in FIG. 6 and includes a truncated upper tapered portion 84 having an interior channel 86 for receiving power cable 64 therethrough. Upper portion 84 includes a pair of side tabs or wings 88 having apertures 90 therethrough. Apertures 90 are designed to receive corresponding fasteners 80 for threaded engagement with intake housing 18. To prevent fluid leakage past cable 64, a tapered packing 91 may be inserted between cable 64 and interior channel 86 during field installation, as illustrated in FIG. 6A. Tapered packing 91 may be either preformed or flexible, so that it wraps around cable 64. Packing 91 preferably is formed of a deformable material, such as lead, rubber or plastic.

Figure 7A:
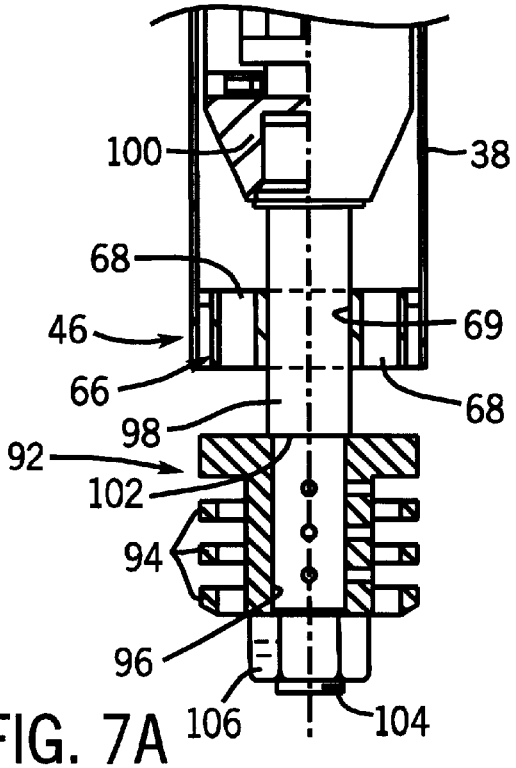
FIG. 7A is an enlarged portion encircled by the line 7A—7A of FIG. 7.
Figure 7:
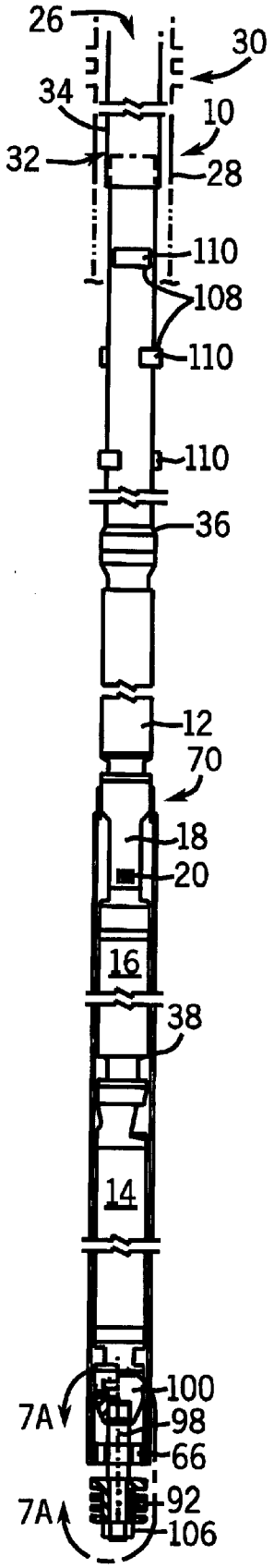
FIG. 7 is a front elevational view of an alternate embodiment of the system illustrated in FIG. 1.

As illustrated in FIGS. 7 and 7A, pumping system 10 may be modified by the addition of a lower scraper 92, sometimes referred to as a bullnose scraper. Bullnose scraper 92 includes a plurality of scraper ribs 94 designed to scrape unwanted debris or materials from the interior of casing 28 during deployment of submergible pumping system 10. The removal of such debris and deposits helps prevent damage to the sheet material forming shroud 38 and ensures that external flow path 40 is not obstructed.

Scraper 92 also includes an axial opening 96. Axial opening 96 is sized to receive a mounting stud 98 that is mounted to and extends from a motor base 100 of submergible motor 14. Stud 98 includes a shoulder 102 and a distal threaded region 104 designed for threaded engagement with a retainer nut 106. Retainer nut 106 secures bullnose scraper 92 on stud 98 between shoulder 102 and retainer nut 106. The opening 69 in end ring 66 is sized to receive stud 98 therethrough. The stud 98 transfers any resistance thrust encountered during deployment to the motor rather than to the sheet metal shroud 38, the motor being stronger than the shroud. Also, should the sheet metal shroud 38 become detached from the intake housing 18, as by corrosion, the bullnose scraper 92 and stud 98 enable the shroud to be retrieved from the well.

Submergible pumping system 10 may also include an upper scraper 108 mounted above submergible pump 12 and shroud 38. Upper scraper 108 includes a plurality of whole or partial scraper rings 110. Scraper rings 110 are primarily designed to scrape deposits and other collected material from the interior of wellbore casing 28 when submergible pumping system 10 is removed from a wellbore location. The scrapers facilitate the removal of submergible pumping system 10 while limiting damage to shroud 38 and other submergible pumping system components.

Figure 8:
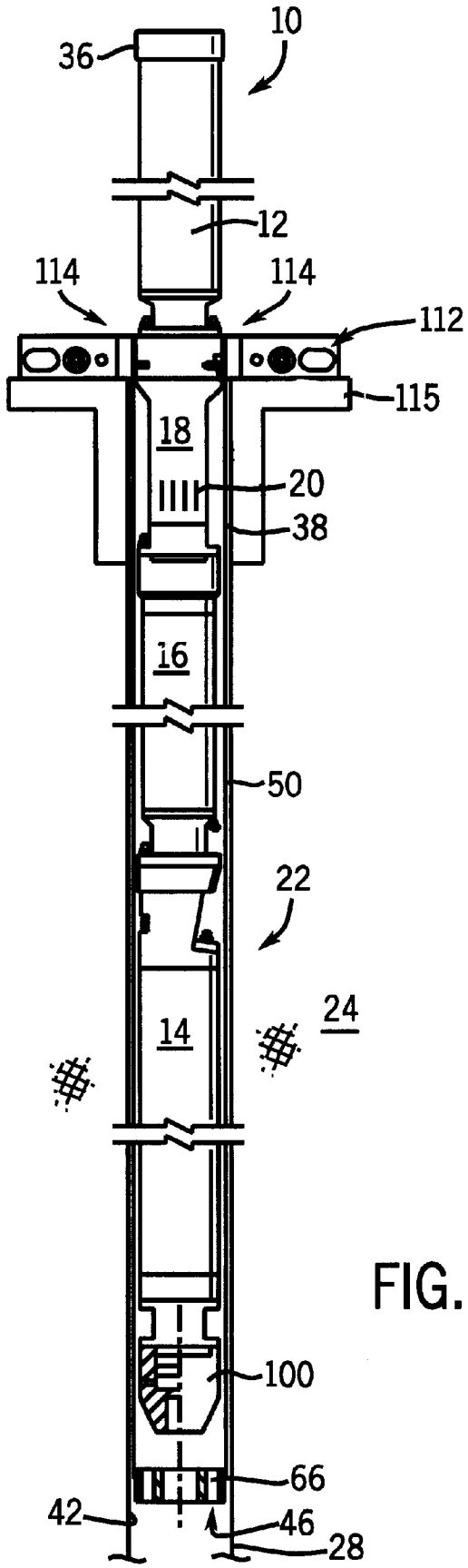
FIG. 8 is a front elevational view of the system illustrated in FIG. 1 suspended from an assembly clamp.

As illustrated in FIG. 8, a special clamp 112 may be used to facilitate deployment of the pumping system into the shroud. Clamp 112 mounts on the shroud by fasteners, such as bolts, that pass engagingly through holes in the clamp and thread into holes 113 (see FIG. 6) in lugs 76. The inside diameter of clamp 112 may be slightly larger than the outside diameter of shroud 38, so that the fastener bolts tend to expand the diameter of the shroud when tightened, facilitating insertion of the submergible pumping system 10 into the shroud.

The clamp 112 may be formed of two separable semicircular halves, as would be known to those of ordinary skill in the art. Each half has two lugs 114 that allow fasteners to join the two halves into a complete circle, that encircles the shroud. Lugs 114 also serve to support the clamp 112 and shroud 38 on a wellhead 115 during deployment.

A preferred exemplary sequence of installation is as follows:

1. Clamp 112 is attached to the shroud lugs 76.
2. Clamp 112 is used to lift the shroud 38 and lower it into wellbore 26, so that the clamp lugs 114 rest on the wellhead 115.
3. Motor 14 with stud 98 attached to the lower end, protector 16, and intake 18 are lowered into shroud 38, either singly or as a subassembly. (If singly, conventional submergible pumping system clamps may be utilized and placed on shroud clamp 112 to support the submergible pumping system components without causing stress to the shroud itself.)
4. During deployment of the submergible pumping system components into the shroud 38, the electrical power cable 64 is deployed into a sufficiently large internal groove 56 of shroud 38 such that it passes through channel 86 of the special lug 72.
5. When intake housing 18 is proximate the top end of shroud 38, fasteners 80, such as bolts, pass non-engagingly through apertures (not shown) in shroud clamp 112. These fasteners then pass engagingly through holes 78 and 90 in lugs 76 (see FIG. 6) and thread into holes 82 in the intake housing 18 or holes in a rotatable ring mounted on intake housing 18.
6. Fasteners attaching clamp 112 to shroud 38 are then removed. Subsequently, fasteners 80 may be fully tightened, slightly reducing the diameter of the shroud, so that it seals effectively to the intake.
7. Clamp 112 is removed from shroud 38.
8. The submergible pumping system string 10 and shroud 38 are lifted clear of the wellhead 115.
9. Bullnose scraper 92 and retainer nut 106 are mounted on the lower end of stud 98, which protrudes from lower end ring opening 69.
10. The submergible pumping system string is then lowered into wellbore 26, and the balance of the submergible pumping system is deployed, as would be known to those skilled in the art.

Figure 8A:
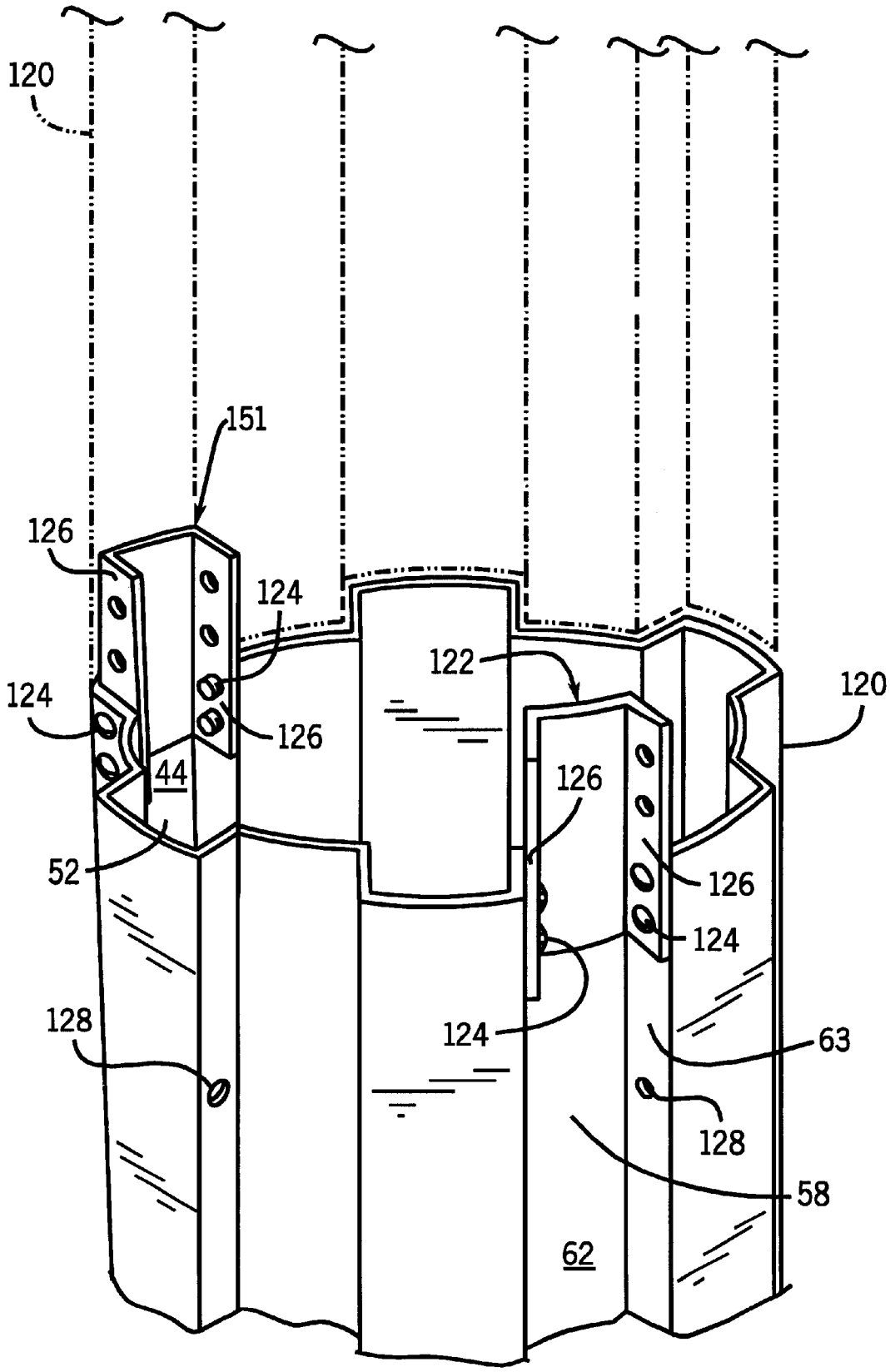
FIG. 8A is a perspective view of a portion of a multi-section shroud, according to an alternate embodiment of the shroud illustrated in FIG. 8.

In some applications, it may be advantageous to divide shroud 38 into multiple sections. For example, if the required length of the shroud is greater than can be transported or installed in a single piece, the shroud may be divided into multiple sections, as illustrated in FIG. 8A. In the exemplary embodiment illustrated, shroud 38 includes a plurality of shroud sections 120 that are joined together.

Multiple shroud sections 120 may be joined by overlapping shroud section ends or by sheet metal splicing channels that are attached to both sections. For example, a joint member 122 or 151, in the form of a sheet metal splicing channel, may be sized for mating engagement with the joined shroud sections 120 along either interior surface 52 or exterior surface 58. In the example illustrated, joint member 122 is disposed on the exterior of shroud sections 120 and matingly engages exterior grooves 62, while joint member 151 is disposed on the interior and matingly engages interior groove 44. The sheet metal splicing channel may be joined to shroud sections 120 by appropriate fasteners, such as screws, rivets or other fastening methods or mechanisms. In the embodiment illustrated, a plurality of fasteners 124, e.g. screws or rivets, are disposed through sidewalls 63 of each shroud section 120. Typically, the sheet metal channel 122 also includes corresponding sidewalls 126 that each lie adjacent a sidewall 63, as best illustrated in FIG. 8A. Fasteners 124 are disposed through adjacent sidewalls 63 and 126 to secure each shroud section 120 to joint member 122 or 151.

During deployment of the overall pumping system 10, each shroud section 120 is supported at the wellhead by an appropriate clamp, similar to clamp 112 discussed above. The clamp, however, preferably is designed for attachment to a shroud section by fasteners, such as screws, that pass through holes 128 formed in sidewalls 63, generally at the upper end of a given shroud section 120. The clamp is designed to support a given shroud section, via fasteners extending through sidewalls 63, to avoid interference with pumping system components as they are inserted into the shroud section 120. Once the supported shroud section 120 is attached to the next sequential shroud section, the clamp may be removed, and holes 128 plugged. Holes 128 may be plugged with, for example, short plugging screws that do not extend beyond the maximum outer diameter of the shroud or the minimum inner diameter of the shroud.

Figure 9:
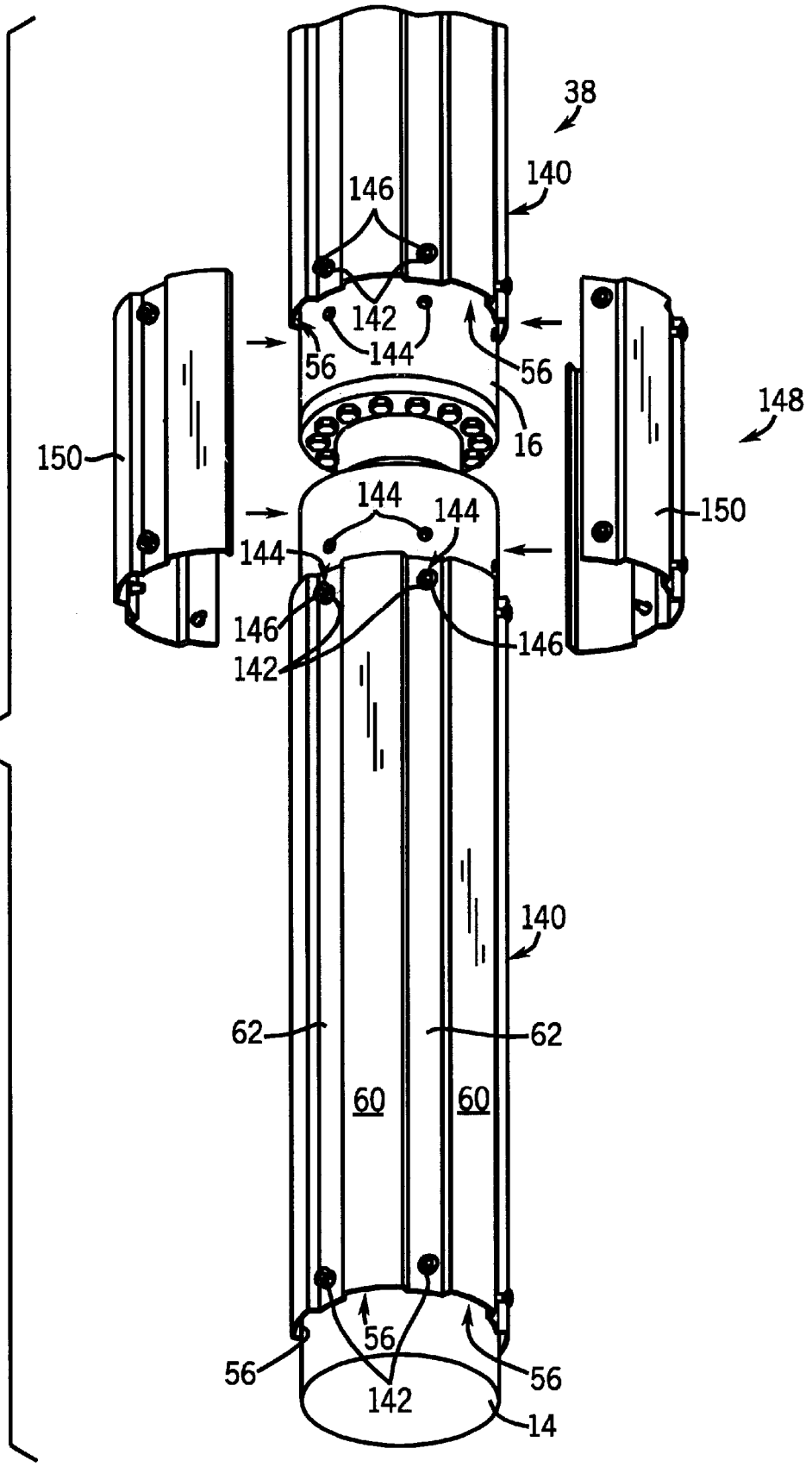
FIG. 9 is a perspective view of an alternate embodiment of the system illustrated in FIG. 1.

Another embodiment of a multi-section shroud is illustrated in FIG. 9. In this system, at least some of the submergible pumping system components, e.g. motor 14 and motor protector 16, are partially encased in sections of shroud 38 before the submergible components are joined together and installed in the well.

In this embodiment, shroud 38 includes a plurality of shroud sections 140 that are fastened to each submergible component. Each shroud section may be attached to a corresponding submergible component by, for example, screws, rivets, welding, adhesives, etc. In the embodiment illustrated, each shroud section 140 includes a plurality of openings 142 disposed radially therethrough at the base of each exterior groove 62. Holes 142 are located for alignment with corresponding threaded openings 144 extending radially inwardly into the outer wall of the submergible component to which that particular shroud section 140 is attached. Appropriate fasteners 146, such as screws, are inserted through holes 142 and threadably engaged with threaded openings 144 to secure each shroud section 140 to a corresponding submergible component, as illustrated in FIG. 9.

Attachment of shroud sections 140 directly to submergible components facilitates attachment of the bullnose scraper 92 when, for example, the required length of a unitary shroud would be to great to lift the shroud clear of the wellhead during installation. In this system, the bullnose scraper 92 may be attached to the lowermost submergible section before it is installed in the well. Additionally, a sectional shroud of the type illustrated permits access to certain areas of the submergible components to permit joining of the submergible components and to facilitate the overall installation procedure. Exemplary access areas include clamp grooves, end flanges, fluid ports, electrical connections, etc.

When an access area is no longer needed, that area is covered by a supplemental shroud section 148. In the embodiment illustrated, each supplemental shroud section 148 is divided into a pair of components 150 that have ridges and grooves corresponding to the ridges and grooves of the sequential shroud sections 140. It should be noted that a variety of single piece or multiple piece supplemental shroud sections 148 can be designed.

The illustrated components 150 include a plurality of holes 142 located for alignment with corresponding threaded openings 144. As described above with respect to each shroud section 140, fasteners, such as screws 146, may be inserted through holes 142 in each component 150 and threadably engaged with a corresponding threaded opening 144 formed in the enclosed, submergible components. Upon installation of the supplemental shroud section 148, the entire shroud 38 is completed to permit the appropriate flow of fluid along external grooves 62 and internal grooves 56.

It will be understood that the foregoing description is of preferred embodiments of this invention, and that the invention is not limited to the specific forms shown. For example, a variety of materials potentially may be used in constructing the shroud; various other or additional components can be contained within the shroud or mounted above the shroud; varying numbers and sizes of corrugations may be formed in the shroud; and the sequence and arrangement of the pumping system components and installation procedure can be changed to suit a specific pumping application. These and other modifications may be made in the design and arrangement of the elements without departing from the scope of the invention as expressed in the appended claims.

What is claimed is:

1. A device for directing a production fluid along a motor used in a submergible pumping system that is deployable in a wellbore, comprising:

a motor shroud sized to fit within a wellbore, the motor shroud having a wall that defines an inner flow path of sufficient size to permit a fluid flow adjacent a motor contained therein, the wall being corrugated.

2. The device as recited in claim 1, wherein the wall is formed of a metal material.

3. The device as recited in claim 1, wherein the wall includes an inner surface having a plurality of ridges and a plurality of grooves that are generally aligned with the inner flow path.

4. The device as recited in claim 3, wherein the plurality of ridges extend along and adjacent to the motor.

5. The device as recited in claim 1, wherein the motor shroud includes a lower portion at which the fluid flow enters the motor shroud.

6. A submergible pumping system for use in pumping a production fluid from a subterranean well, comprising:

a submergible pump in fluid communication with a pump intake opening;

a submergible motor operably coupled to the submergible pump; and a motor shroud disposed over at least the submergible motor and the pump intake opening; the motor shroud being formed by a wall of sheet material having a plurality of strengthening regions;

the strengthening regions comprising:

a plurality of longitudinal grooves; and a plurality of longitudinal ridges.

7. The submergible pumping system as recited in claim 6, wherein the sheet material comprises a sheet metal.

8. The submergible pumping system as recited in claim 6, wherein the plurality of longitudinal grooves and the plurality of longitudinal ridges are arranged in an alternating pattern.

9. The submergible pumping system as recited in claim 8, wherein the wall has an inner surface that defines a fluid flow path along the longitudinal grooves through which a production fluid may flow to the pump intake opening.

10. The submergible pumping system as recited in claim 9, wherein the wall includes an outer surface defined by a plurality of outer longitudinal grooves and a plurality of outer longitudinal ridges.

11. The submergible pumping system as recited in claim 9, further comprising a plurality of lugs disposed in the plurality of longitudinal grooves above the pump intake opening.

12. The submergible pumping system as recited in claim 9, wherein the longitudinal grooves of the plurality of longitudinal grooves have varying cross-sectional areas.

13. The submergible pumping system as recited in claim 6, further comprising a bullnose scraper disposed at a lower end of the motor shroud.

14. The submergible pumping system as recited in claim 6, further comprising an upper scraper disposed above the motor shroud.

15. The submergible pumping system as recited in claim 6, further comprising a shroud clamp that selectively may be coupled to one or more of a plurality of submergible pump system components to support the weight of the shroud, while allowing the shroud to be attached to the submergible pumping system.

16. A method of cooling a downhole component of a submergible pumping system disposed in a narrow wellbore, comprising:

placing a sheet material around the downhole component to form an interior flow path between the sheet material and the downhole component and an exterior flow path between the sheet material and the narrow wellbore;

strengthening the sheet material to withstand radially and longitudinally directed forces, wherein the strengthening comprises forming the sheet material as a corrugated shroud having a series of ridges and grooves generally aligned with a fluid flow direction;

drawing a wellbore fluid through the exterior flow path in a first direction; and drawing the wellbore fluid through the interior flow path in a second direction.

17. The method as recited in claim 16, wherein forming includes forming the corrugated shroud from sheet metal.

18. The method as recited in claim 16, wherein placing includes placing the sheet material around a submergible motor.

19. The method as recited in claim 18, wherein placing includes disposing at least a portion of the sheet material in contact with the submergible motor.

20. A method of assembling and deploying a submergible pumping system in a wellbore, the submergible pumping system having a plurality of submergible components and a shroud disposed about at least one of the submergible components, the shroud having a deformable sidewall and an upper attachment end by which the shroud is coupled to at least one of the submergible components, comprising:

assembling the shroud and the submergible components that are at least partially contained with the shroud;

mounting a clamp about at least one of the submergible components above or at one end of the deformable sidewall;

supporting the clamp proximate an upper opening of the wellbore; and assembling the remainder of the submergible pumping system above the clamp.

21. The method as recited in claim 20, further comprising deploying the submergible pumping system to a desired location in the wellbore.

22. The method as recited in claim 20, wherein mounting includes mounting the clamp about the upper attachment end.

23. The method as recited in claim 20, further comprising mounting a bullnose to a bottom end of the shroud.

24. The method as recited in claim 23, further comprising mounting a wellbore scraper above the shroud.

25. A submergible pumping system for use in pumping a production fluid from a subterranean well, comprising:

a submergible pump in fluid communication with a pump intake opening;

a submergible motor operably coupled to the submergible pump; and a motor shroud disposed over at least the submergible motor and the pump intake opening, the motor shroud including a plurality of sections and at least one joint member to couple the plurality of sections together for continuous fluid flow along the shroud, wherein the motor shroud is made of a sheet material that has corrugation.

26. The submergible pumping system as recited in claim 25, wherein the plurality of sections are formed from a sheet material.

27. The submergible pumping system as recited in claim 26, wherein the sheet material is a sheet metal material.

28. The submergible pumping system as recited in claim 25, wherein the joint member comprises a supplemental corrugated section of sheet material.

29. The submergible pumping system as recited in claim 25, wherein each section of the plurality of sections are fastened to a corresponding submergible component.

30. A method of cooling at least one component of a submergible pumping system disposed in a wellbore, comprising:

forming a plurality of shroud sections, each having an interior opening sized to receive a submergible pumping system component while leaving a fluid flow path along the submergible pumping system component; and orienting the plurality of shroud sections to provide a continuous fluid flow path along the plurality of shroud sections, wherein the forming includes forming the plurality of shroud sections from a sheet material having longitudinal corrugations.

31. The method as recited in claim 30, wherein forming includes forming the plurality of shroud sections from a sheet material.

32. The method as recited in claim 31, further comprising connecting each shroud section to a corresponding submergible component.

33. The method as recited in claim 31, further comprising fastening each shroud section to a next adjacent shroud section.

34. The method as recited in claim 30, wherein forming includes forming a plurality of corrugated shroud sections having longitudinal corrugations; and orienting includes aligning the longitudinal corrugations to form an internal and an external fluid flow path.

* * * * *